US006518585B1

(12) United States Patent
Gluschke et al.

(10) Patent No.: US 6,518,585 B1
(45) Date of Patent: Feb. 11, 2003

(54) METHOD FOR MANUFACTURING A CONTAINER AND CONTAINER

(75) Inventors: Konrad Gluschke, Wickede (DE); Reinhard Struth, Beckum (DE)

(73) Assignee: GNB Gesellschaft für Nuklearbehälter mbH (DE)

( * ) Notice: Subject to any disclaimer, the term of this patent is extended or adjusted under 35 U.S.C. 154(b) by 0 days.

(21) Appl. No.: 09/446,502

(22) PCT Filed: Jun. 9, 1998

(86) PCT No.: PCT/DE98/01608

§ 371 (c)(1),
(2), (4) Date: Dec. 20, 1999

(87) PCT Pub. No.: WO98/59346

PCT Pub. Date: Dec. 30, 1998

(30) Foreign Application Priority Data

Jun. 19, 1997 (DE) ..... 197 25 922

(51) Int. Cl.[7] ..... G21F 5/00
(52) U.S. Cl. ..... 250/506.1

(58) Field of Search ..... 250/506.1, 507.1

(56) References Cited

U.S. PATENT DOCUMENTS 3,742,985 A * 7/1973 Rubenstein ..... 138/141
5,008,045 A * 4/1991 Manchak et al. ..... 250/506.1
5,819,186 A * 10/1998 Stephens ..... 250/506.1
5,949,084 A * 9/1999 Swartz ..... 250/506.1
6,046,374 A * 4/2000 Stephens ..... 250/506.1
6,299,950 B1 * 10/2001 Byington et al. ..... 250/506.1

* cited by examiner

*Primary Examiner*—Bruce Anderson
(74) *Attorney, Agent, or Firm*—R W Becker & Associates; R W Becker

(57) ABSTRACT

The invention relates to a method for producing a container designed to transport and store radioactive material. The invention further relates to a container which is used to transport and store radioactive material. First and foremost, claim is laid to the selection of a heavy concrete and a special technique for inserting the heavy concrete between metall walls.

19 Claims, 2 Drawing Sheets

METHOD FOR MANUFACTURING A CONTAINER AND CONTAINER

BACKGROUND OF THE INVENTION

The invention concerns a method for manufacturing a container for transportation and storage of a radioactive material as well as a container within which a radioactive material can be transported and stored.

In the past, such containers became of great importance in the form of so-called "Castor containers". They serve for transporting radioactive material, for example spent fuel elements from nuclear reactors, from the power plant to an interim storage or ultimate waste disposal site.

Sometimes, long distances have to be covered in that. Such a transportation requires an extremely high degree of security. This is true not only for the carrier vehicles (trucks, trains, ships) but also, above all, for the containers in which the fuel elements are transported, for example.

Above all, that involves two security aspects:

1. The container has to be constructed to prevent reliably an escape of radioactive radiation and gases.
2. The container has to be designed in such a manner that the security according to 1. persists even if an accident occurs, for example the container falling down from a carrier vehicle.

In that, the demands on the radioactive screening of the container are as great as on the strength and stability thereof.

SUMMARY OF THE INVENTION

Based on these aspects, it is an object of the invention to provide a method for manufacturing an appropriate container and a container meeting the demands mentioned above.

Among the radioactive beams, there are alpha rays, beta rays, gamma rays and neutron beams. Generally, alpha and beta rays have short ranges so that small material thicknesses (in the order of several millimeters) are sufficient to screen them. Therefore, the main thing in projecting a radiation protection container is the attenuation and absorption of the neutron and gamma radiation.

It is known in this context that the mass and thus the bulk density of an appropriate container wall is an important property.

In so far, steel containers as the mentioned Castor container were used in the past. Besides, so-called containers of steel/armoured concrete are known, which are constructed of a combination of steel/concrete.

The invention is based on the knowledge that the screening effect of such containers of steel/armoured concrete can be obtained by a special selection of a heavy concrete between steel walls.

The invention in its most general embodiment proposes a method for manufacturing a container for transportation and storage of radioactive material, having the following features:

an inner tube of metal is placed into an outer tube of metal in such a manner that an annular gap of a constant width is formed between the inner and outer tubes, the annular gap is then filled with an aggregate or a mixture of aggregates, the minimum grain size of which is 2 mm and the maximum grain size of which is 20 mm, at least 95% by wt. of the aggregate having a bulk density>4.2 g/cm$^3$, afterwards, a suspension of cement, water and a liquefier is injected under high pressure into the annular gap through at least one opening at the bottom end of the inner and/or outer tube until the suspension reaches the upper end of the outer tube in filling the gores existing between the aggregate totally, the suspension of cement, water and liquefier being adjusted in such a manner that the concrete being formed (together with the aggregate) has a bulk density>4,100 g/cm$^3$ and a compressive strength of concrete according to DIN 1048, part 2 of >45 N/mm$^2$ after 28 days.

The essential aspect of this method is the special technique for introducing the heavy concrete between the metal walls.

With a ready-made concrete mixture which would be filled into the annular gap, the required bulk densities and compressive strengths as well as the necessary screening from radioactive radiation could not be obtained.

This can be successful only by the selection of special aggregates which are filled into the annular gap in a first step and by the following injection of the cement paste under pressure, the filling degree of the cement paste being optimized substantially in that the injection is effected from the bottom to the top. In this way, an excellent and almost optimum filling of the gores between the aggregate parts can be effected and thus a dense high-strength concrete can be formed in the annular space.

Here, the term cement is used for all types of hydraulic binders. However, Portland cements are preferably used, that is Portland cements of the type CEM I 42.5 or with higher values (e.g. CEM I 52.5).

Aggregates having the required bulk density are for example barite, ferrophosphorus, magnetite, iron (steel), lead, hematite and granulated chill-cast iron as well as other metals, particularly heavy metals, the aggregates being able to be used individually or in mixtures.

A mixture of barite, ferrophosphorus, magnetite, hematite or mixtures thereof in combination with steel balls lead to very good values of density and compressive strength of the green concrete and the set concrete, respectively.

Various mixtures of aggregates have been tested in preliminary tests. Accordingly, mixtures of aggregates of barite, ferrophosphorus, magnetite, hematite or mixtures thereof having the grain fractions of 4 to 8 mm as well as 8 to 16 mm in combination with steel balls having a diameter between 4 and 10 mm show particularly favourable characteristics. The steel balls may have a spherical shape or be replaced totally or partly by lead balls or granulated chill-cast iron.

For example the quantities of the individual aggregate components may be as follows:

the aggregate of the grain fraction 4/8: 15 to 25% by wt.

the aggregate of the grain fraction 8/16: 15 to 25% by wt.

the steel balls having a diameter between 4 and 10 mm: 45 to 55% by wt.

As far as metal tubes have been mentioned above, this term particularly includes steel tubes, and here particularly steel tubes having a circular cross section, even though other shapes of cross section can be used as well, for example polygons.

An embodiment of the method provides to use an inner tube which is closed at its upper end and is shorter than the outer tube. In this case, the outer tube and the inner tube are placed on a base (a plate), for example, and then not only the annular space between the inner and outer tubes but also the space between the closed upper end of the inner tube and the upper edge of the outer tube is filled with the aggregate.

Then, besides the annular space, the space between the closed end of the inner tube and the upper edge of the outer tube is filled as well with the suspension of cement/water/liquefier. In this way, a kind of "concrete cover" is produced, which forms the container bottom in later application (after turning about 180°). Additionally, a plate of metal/steel may be secured to the upper edge of the outer tube, for example by screwing or welding.

The manufacturing method is simplified, if the inner tube and the outer tube are closed at their lower end with a cover of metal/steel before the aggregate is filled in. Preferably, this is done by screwing it onto the corresponding tube ends. In this way, a coaxial alignment of the inner and outer tubes is facilitated, that is also in filling-in the aggregate and in injecting the cement suspension, respectively.

This end being the lower container end in manufacturing the container forms the upper container end in the ready container (after turning about 180°). In this way, spent fuel elements may be inserted into the free space of the inner tube after screwing-off the steel cover, and then the container may be closed again.

The stability of the container is considerably improved if a reinforcement is inserted into the annular gap and into the space formed between the upper closed end of the inner tube and the open end of the outer tube, respectively, before the aggregate is filled in. The heat dissipation in the hydration of the cement is improved as well thereby.

Such a reinforcement may consist of a reinforcing cage extending substantially over the entire volume of the annular gap and said space, respectively.

As has been said that the cement suspension is injected under high pressure, this means first of all a pressure over 1 bar. With an increasing filling height in the annular gap and a correspondingly higher hydrostatic pressure, it is necessary to increase the injection pressure of the cement suspension as well, which may lead to an injection pressure up to 15 bars depending on the container height (for example 3 m).

Here, the width of the annular gap is assumed to be 20 to 30 cm, for example. The said "bottom plate of concrete" may also have a corresponding thickness.

Because the density of steel is higher than the density of the heavy concrete, the container covers at the ends may have wall thicknesses which are a little lower, for example 5 to 15 cm.

As mentioned above, the invention also includes a container for transportation and storage of radioactive material, characterized by the following features:

The container consists of an outer tube of metal and an inner tube of metal being disposed therein with the same distance all around, an annular gap having a constant width being formed thereby between the inner and outer tubes, the annular gap between the inner and outer tubes is filled with a heavy concrete consisting of an aggregate or a mixture of aggregates having a bulk density>4.2 g/cm$^3$, and a cement filling the gores between the aggregate, the heavy concrete having a bulk density of >4,100 g/cm$^3$ and a compressive strength after 28 days according to DIN 1048, part 2 of >45 N/mm$^2$, and the outer tube and the inner tube being closed at the ends with a metal bottom and a metal cover, at least the metal cover being disposed removably.

In an embodiment, the container may be formed in such a manner that the inner tube ends at a distance from the lower end of the outer tube, is closed at this end, and a plate of heavy concrete exists between the closed lower end of the inner tube and the lower end of the outer tube, which is continuous in material with the heavy concrete in the annular gap.

This embodiment describes the container in usage condition. For manufacturing the inner and outer tubes are arranged in a condition turned at 180°, as described above.

According to the claimed method the heavy concrete may be reinforced, the reinforcement consisting of a reinforcing cage, for example.

BRIEF DESCRIPTION OF THE DRAWINGS

The object and advantages of the present invention will appear more clearly from the following specification in conjunction with accompanying drawings, in which.

DESCRIPTION OF PREFERRED EMBODIMENTS

Figure 1:
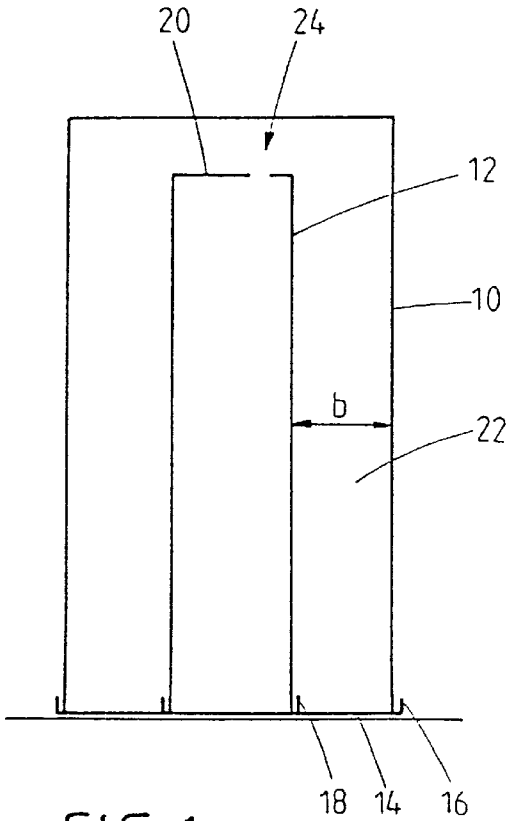
FIG. 1 an arrangement of the outer and inner tubes of steel before the concrete aggregate is filled-in, FIG. 2 the arrangement according to FIG. 1, the space formed between the outer and inner tubes being filled with an aggregate, FIG. 3 the arrangement according to FIG. 2, wherein the space between the outer and inner tubes is filled additionally with a cement suspension for about one half, FIG. 4 a finished container in longitudinal section.

In FIG. 1, an outer tube 10 of steel and an inner tube 12 of steel arranged concentrically therein can be seen.

The outer tube 10 and the inner tube 12 stand with their respective lower end on a cover 14, the cover 14 being screwed onto corresponding external threads at the lower end of the outer tube 10 and the inner tube 12 by two concentric flanges 16, 18 having internal threads.

The inner tube 12 is shorter than the outer tube 10 and ends correspondingly at a distance from the upper edge of the outer tube 10. The inner tube 12 is closed with a steel plate 20 at the upper end.

Accordingly, an annular gap 22 of constant width (b) is formed between the outer tube 10 and the inner tube 12 and a space 24 is formed between the steel plate 20 and the upper end of the outer tube 10.

Figure 2:
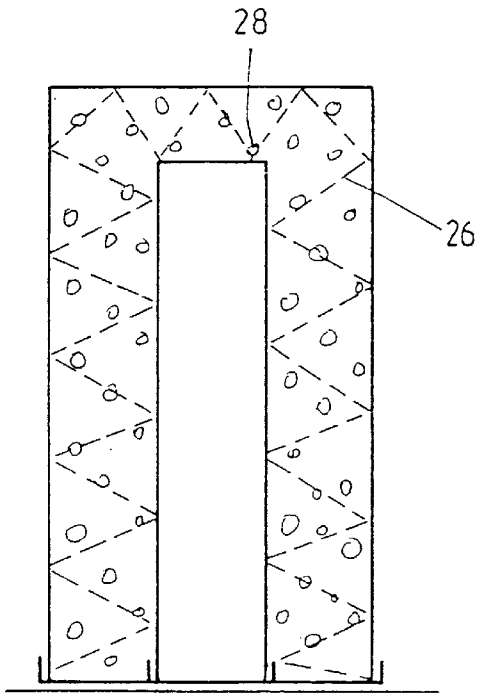

In the next step, the annular gap 22 and the space 24 are filled with a reinforcing cage 26 of steel (FIG. 2). The reinforcement may also be fixed beforehand to the inner wall of the outer tube and/or the outer wall of the inner tube, for example by welding.

Then, a heavy concrete aggregate is filled into the annular gap 22 and the space 24, here consisting of 20% by wt. of barite of the grain fraction ⅛ mm, 30% by wt. of barite of the grain fraction 8/16 mm and 50% by wt. steel balls having a diameter between 5 and 8 mm, being mixed homogeneously (FIG. 2).

Figure 3:
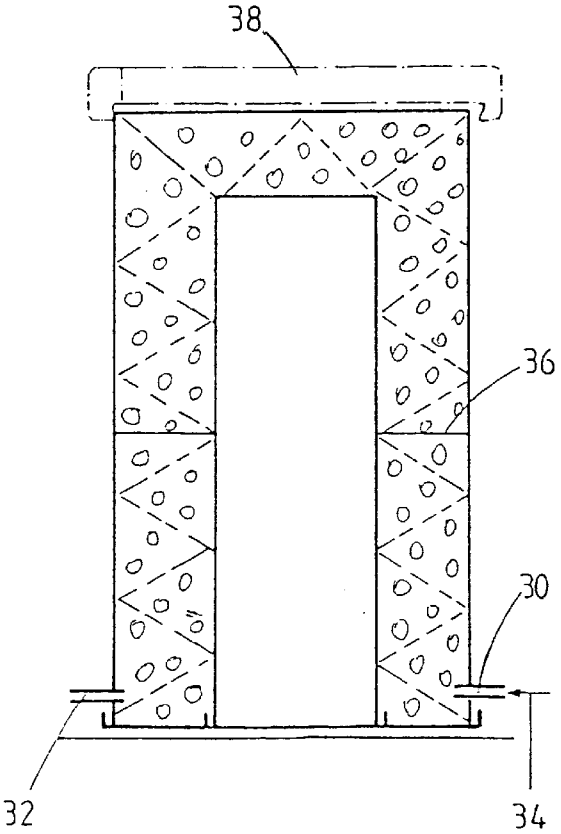

Afterwards, there follows the injection of a mixture of cement/water/liquefier into the space being occupied by the reinforcing cage 26 and the aggregate 28 (FIG. 3).

For that, the outer tube 10 has two openings 30 offset at 180°, into each of which a tubular adapter 32 is screwed. The openings are situated at the lower end of the outer tube 10.

A delivery pipe (shown schematically by arrow 34) is then connected to the adapters 32.

Then, a mixture of cement/water/liquefier in the form of a viscous suspension is injected under pressure into the annular gap 22 through the delivery pipe. In the present case the suspension consists of cement of the type CEM I 42.5, a water content of 35% on the basis of the cement, and a portion of 3% liquefier (here: melamine sulfonate), on the basis of the cement portion.

While the cement suspension reaches the inside of the cover 14 directly after beginning the injection, the annular gap 22 is then filled gradually from the bottom to the top with the cement suspension, which fills the free spaces (gores) between the aggregate parts and the reinforcement in the process.

In FIG. 3, a filling of about 50% of the annular gap 22 is indicated by line 36.

In continually increasing the injection pressure (up to about 15 bars) the injection of the cement suspension is continued until the annular gap 22 and the space 24 above it are filled totally with the cement suspension.

The cement having set and hardened, a steel plate 38 (illustrated in dashed lines in FIG. 3) is welded to the upper end of the outer tube 10.

Figure 4:
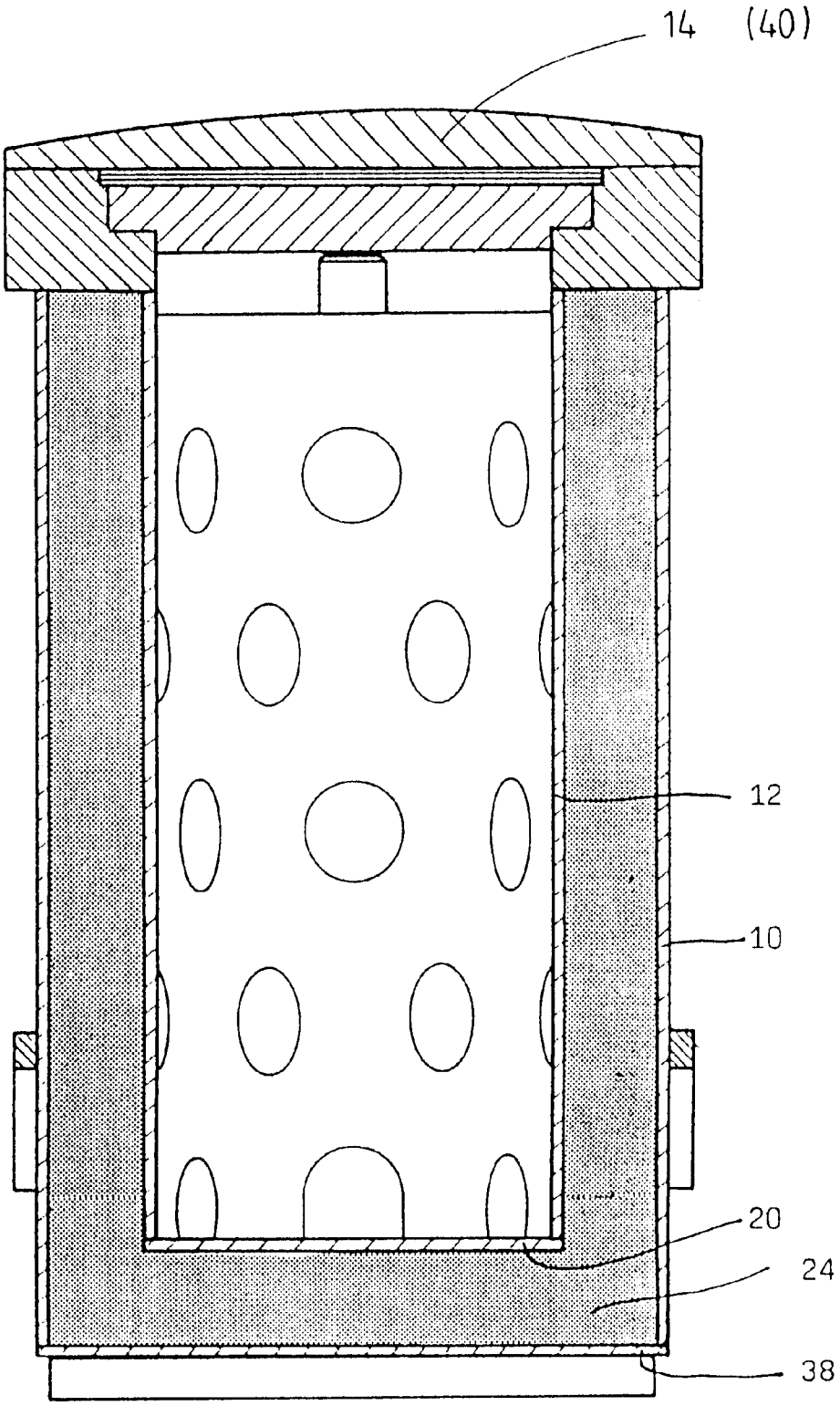

Then, the arrangement is turned about 180° (FIG. 4). If required, the container cover 14 may be replaced by another steel cover 40.

Preferably, the openings 30 on the finished container are closed.

The compressive strength after 7 days according to DIN 1048, part 2 of the heavy concrete is 26 $N/mm^2$, the corresponding compressive strength after 28 days is 46 $N/mm^2$.

The modulus of elasticity of the concrete was determined following DIN 1048, part 5: 30,000 $N/mm^2$.

What is claimed is:

1. A method for manufacturing a container for transportation and storage of radioactive material, having the following steps:

1.1 an inner tube of metal is placed into an outer tube of metal in such a manner that an annular gap of a constant width is formed between the inner and the outer tubes, 1.2 the annular gap is then filled with an aggregate or a mixture of aggregates, the minimum grain size of which is 2 mm and the maximum grain size of which is 20 mm, at least 95% by wt. of the aggregate having a bulk density>4.2 $g/cm^3$, 1.3 afterwards, a suspension of cement, water and liquefier is injected under high pressure into the annular gap through at least one opening at the bottom end of the inner and/or the outer tube until the suspension reaches the upper end of the outer tube in filling the gores existing between the aggregate totally, 1.4 the suspension being adjusted in such a manner that the concrete being formed together with the aggregate has a bulk density>4,100 $g/cm^3$ and the set cement together with the aggregate within the annular gap has a compressive strength of concrete according to DIN 1048, part 2 of >45 $N/mm^2$ after 28 days.

2. The method according to claim 1, wherein a Portland cement of the type CEM I 42.5 or having higher values is used as the cement.

3. The method according to claim 1, wherein barite, ferrophosphorus, magnetite, iron, lead, hematite, granulated chill-cast iron as well as other metals or mixtures of the mentioned aggregates are used as the aggregate.

4. The method according to claim 3, wherein a mixture of barite, ferrophosphorus, magnetite, hematite or mixtures thereof in combination with steel balls are used as the aggregate.

5. The method according to claim 4, wherein a mixture of barite, ferrophosphorus, magnetite, hematite or mixtures thereof having the grain fractions ⅛ mm and 8/16 mm in combination with steel balls having a diameter between 4 and 10 mm are used as the aggregate.

6. The method according to claim 4, wherein a mixture of barite, ferrophosphorus, magnetite, hematite or mixtures thereof with a 15 to 25% by wt. portion of a grain fraction ⅛ mm and a 25 to 35by wt. portion of a grain fraction 8/16 mm in combination with 45 to 55% by wt. of steel balls having a diameter between 4 and 8 mm are used as the aggregate.

7. The method according to claim 1, wherein an inner tube being closed at its upper end is used, which is shorter than the outer tube, the space between the upper closed end of the inner tube and the upper edge of the outer tube being also filled with the aggregate and the gores between the aggregate being filled with the suspension.

8. The method according to claim 7, wherein a reinforcement is inserted into the annular gap and/or the space formed between the upper closed end of the inner tube and the open end of the outer tube before the aggregate is filled.

9. The method according to claim 8, wherein a reinforcing cage extending essentially over the entire volume of the annular gap and/or the space is used as the reinforcement.

10. The method according to claim 1, wherein the inner tube and the outer tube are closed with a metal cover at their lower ends before the aggregate is filled in.

11. The method according to claim 1, wherein a reinforcement is inserted into the annular gap and/or the space formed between the upper closed end of the inner tube and the open end of the outer tube before the aggregate is filled in.

12. The method according to claim 11, wherein a reinforcing cage extending essentially over the entire volume of the annular gap and/or the space is used as the reinforcement.

13. The method according to claim 1, wherein the upper, the lower or the upper and lower end of the outer tube is closed sealingly with a metal cover or a metal top after the suspension has set, at least one metal cover or metal top being placed removably onto the outer tube.

14. A container for transportation and storage of radioactive material having the following features:

12.1 the container consists of an outer tube (10) of metal and an inner tube (12) of metal being disposed therein with the same distance all around, an annular gap (22) having a constant width being formed thereby between the inner and outer tubes (12, 10), 12.2 the annular gap (22) between the inner and outer tubes (12, 10) is filled with a heavy concrete consisting of an aggregate or a mixture of aggregates (28) having a bulk density>4.2 $g/cm^3$ and a cement filling the gores between the aggregate, the heavy concrete having a bulk density of >4,100 $g/cm^3$ and a compressive strength after 28 days according to DIN 1048, part 2 of >45 $N/mm^2$, 12.3 the outer tube (10) and the inner tube (12) are closed at the ends with a metal bottom (38) and a metal cover (14), at least the metal cover (14) being disposed removably.

15. The container according to claim 14, wherein the inner tube (12) ends at a distance from the lower end of the outer tube (10), is closed at this end, and a plate of heavy concrete exists between the closed lower end of the inner tube (12) and the lower end of the outer tube (10), which is continuous in material with the heavy concrete in the annular gap.

16. The container according to claim 15, wherein the heavy concrete is reinforced.

17. The container according to claim 16, wherein the reinforcement consists of a reinforcing cage (26).

18. The container according to claim 14, wherein the heavy concrete is reinforced.

19. The container according to claim 18, wherein the reinforcement consists of a reinforcing cage (26).

* * * * *

UNITED STATES PATENT AND TRADEMARK OFFICE

CERTIFICATE OF CORRECTION

PATENT NO. : 6,518,585 B1 
DATED : February 11, 2003
INVENTOR(S) : Gluschke et al.

It is certified that error appears in the above-identified patent and that said Letters Patent is hereby corrected as shown below:

Column 6,
Lines 4-10, claim 6 should read as follows:

6. The method according to claim 4, wherein a mixture of barite, ferrophosphorus, magnetite, hematite or mixtures thereof with a 15 to 25% by wt. portion of a grain fraction 4/8 mm and a 25 to 35% by wt. portion of a grain fraction 8/16 mm in combination with 45 to 55% by wt. of steel balls having a diameter between 4 and 8 mm are used as the aggregate.

Lines 66 and 67, claim 16 should read as follows:

16. The container according to claim 14, wherein the heavy concrete is reinforced.

Column 7,
Lines 3 and 4, claim 18 should read as follows:

18. The container according to claim 15, wherein the heavy concrete if reinforced.

Signed and Sealed this

Fifth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,518,585 B1 
DATED : February 11, 2003
INVENTOR(S) : Gluschke et al.

It is certified that error appears in the above-identified patent and that said Letters Patent is hereby corrected as shown below:

Column 6,
Lines 4-10, claim 6 should read as follows:
6. The method according to claim 4, wherein a mixture of barite, ferrophosphorus, magnetite, hematite or mixtures thereof with a 15 to 25% by wt. portion of a grain fraction 4/8 mm and a 25 to 35% by wt. portion of a grain fraction 8/16 mm in combination with 45 to 55% by wt. of steel balls having a diameter between 4 and 8 mm are used as the aggregate.
Lines 66 and 67, claim 16 should read as follows:
16. The container according to claim 14, wherein the heavy concrete is reinforced.

Column 7,
Lines 3 and 4, claim 18 should read as follows:
18. The container according to claim 15, wherein the heavy concrete is reinforced.

This certificate supersedes Certificate of Correction issued August 5, 2003.

Signed and Sealed this

Twenty-fifth Day of November, 2003

JAMES E. ROGAN
*Director of the United States Patent and Trademark Office*